United States Patent [19]

Fletcher et al.

[11] 4,027,494

[45] June 7, 1977

[54] LOW GRAVITY PHASE SEPARATOR

[76] Inventors: James C. Fletcher, Administrator of the National Aeronautics and Space Administration, with respect to an invention of; George F. Smoot, Berkeley; William L. Pope, Walnut Creek; Lawrence Smith, Santa Clara, all of Calif.

[22] Filed: Sept. 12, 1975

[21] Appl. No.: 612,966

[52] U.S. Cl. ..... 62/50; 55/3; 55/100; 55/269; 62/514 R; 137/197; 210/222

[51] Int. Cl.[2] ..... F17C 7/02

[58] Field of Search ..... 62/9, 11, 40, 3, 45, 62/50, 54, 514 R, 512, 51; 55/3, 100, 269; 210/222, 223; 137/197; 149/2; 423/211

[56] References Cited

UNITED STATES PATENTS

| | | | |
|---|---|---|---|
| 1,056,043 | 3/1913 | Morrison | 55/3 X |
| 1,273,929 | 7/1918 | Morrison | 55/3 X |
| 1,364,136 | 1/1921 | Palmer | 62/3 X |
| 1,575,587 | 3/1926 | Haynes | 55/100 X |
| 3,215,572 | 11/1965 | Papell | 149/2 |
| 3,295,545 | 1/1967 | Papell et al. | 137/197 |
| 3,304,729 | 2/1967 | Chandler et al. | 62/45 |
| 3,358,463 | 12/1967 | Hawkins et al. | 62/45 |
| 3,393,526 | 7/1968 | Pearl | 62/3 |

*Primary Examiner*—Ronald C. Capossela
*Attorney, Agent, or Firm*—Marvin J. Marnock; John R. Manning; Marvin F. Matthews

[57] ABSTRACT

The present invention provides an apparatus for phase separating a gas-liquid mixture as might exist in a subcritical cryogenic helium vessel for cooling a superconducting magnet at low gravity such as in planetary orbit, permitting conservation of the liquid and extended service life of the superconducting magnet.

2 Claims, 3 Drawing Figures

LOW GRAVITY PHASE SEPARATOR

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 45 U.S.C. 2457).

BACKGROUND OF THE INVENTION

1. FIELD OF INVENTION

The present invention relates to apparatus for phase separation of a gas-liquid mixture.

2. DESCRIPTION OF PRIOR ART

Phase separation systems for liquid storage tanks in zero gravity environments, such as in U.S. Pat. No. 3,295,545, have in the past relied on a colloidal suspension of magnetic particles, such as those described in U.S. Pat. No. 3,215,572, in the liquid. The particles were attracted by magnets so that the liquid was retained in the tank, while permitting venting of the gas. However, the colloidal suspension of particles increased the complexity and expense of preparation of the liquid to be used.

Other prior art separators, such as in U.S. Pat. Nos. 1,575,587 and 1,364,136 have utilized differences in the relative magnetic susceptibilities of gases to accomplish magnetic separation.

SUMMARY OF THE INVENTION

Briefly, the present invention provides an apparatus for phase separating a gas-liquid mixture as might exist in a sub-critical cryogenic helium vessel at low gravity, such as a cryogenic chamber for a superconducting magnet used in cosmic ray studies. It is important to conserve as much cryogenic liquid as possible to permit extended duration experiments.

It has been found with the present invention that by placing the gas outlet vent through which the gas is to be vented from the vessel in close proximity to the superconducting magnet, the diamagnetic property of the liquid helium can be used to advantage. Specifically, the diamagnetic liquid helium is repelled by the superconducting magnet and primarily only helium vapor is present at the gas outlet vent, thereby separating the vapor and liquid helium phases, retaining the cryogenic liquid helium in the vessel to thereby extend the service life of the superconducting magnet.

It is an object of the present invention to provide a new and improved low gravity phase separator.

DESCRIPTION OF THE PREFERRED EMBODIMENT

At the outset, it is considered helpful to summarize recent developments in cosmic ray measurement technology. Most terrestrial high-energy particle experiments have measured particle momenta or energies with magnetic spectrometers because they are accurate and simple calibrated. Recent developments with balloon-borne spectrometers indicate that superconducting magnets, maintained in superconduction by a suitable cryogen, are desirable for these experiments, due to the high magnetic fields produced which enable high energy particles to be detected. Because of the high reliability and long cryogen storage time requirements for orbital missions, however, the structural features of a cryostat and superconducting magnet have become important.

Figure 1:
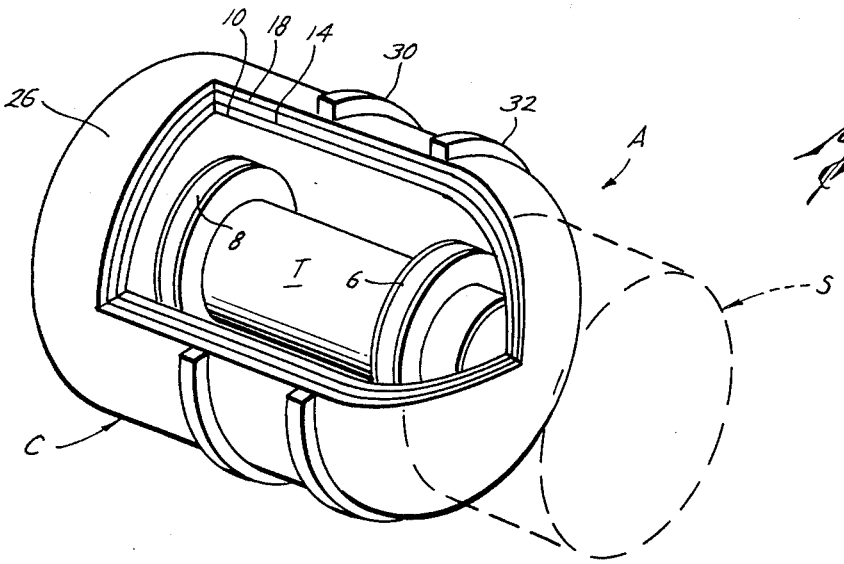
FIG. 1 is an isometric view, partly in cross-section, of a cryogenic vessel for phase separation according to the present invention.

In the drawings, the letter A designates generally the apparatus of the present invention for separating gas and liquid phases of a cryogen under low gravity conditions such as when mounted in an orbiting scientific laboratory or spacecraft (not shown) to reduce venting of the liquid phase of the cryogen and extend the time duration during which cryogenic conditions may be sustained. The apparatus A includes a cryostat C for containing the cryogen, venting structure V for venting the cryogen, primarily the gaseous phase as will be set forth, from the cryostat C and a superconducting magnetic coil M mounted in the cryostat C. As will be set forth below, the magnetic coil M serves as a magnetic field source for orbiting experiments, and in accordance with the present invention repels the liquid phase of the cryogen from the vent structure V to thereby reduce venting of the liquid phase of the cryogen. In order to more clearly set forth the structure of the apparatus A, cryogen supply and flow control structure is shown separately in FIG. 2 from structural features of the cryostat C shown in FIGS. 1 and 3.

The apparatus A is intended for use in conjunction with an orbiting magnetic spectrometer S. Since the spectrometer S, including scintillators and spatial detectors therein, is of conventional construction, it is shown in phantom (FIG. 1) in order to more clearly present structural features of the apparatus A. The spectrometer S is used in experiments for measuring cosmic ray nuclei and like effects, with the superconducting magnetic coil M providing a deflecting magnetic field in the spectrometer S through which the cosmic ray nuclei move. The nuclei are deflected in the spectrometer S by the deflecting magnetic field, with the angle of deflection being proportional to the magnetic field provided by the superconducting magnet M and further being inversely proportional to the momentum per unit charge of charged particles passing through the spectrometer S.

The superconducting magnets M are conventional superconducting Nb-Ti, Cu-Clad twisted multicore wire toroidal magnets, such as those sold by Magnetic Corporation of America and identified as "Kryoconducter". The magnets M include a first coil 6 and a second coil 8 connected in series in the conventional manner.

The first coil 6 is mounted on a support tube T at an end of the cryostat C adjacent the spectrometer S in order to be quite near the spectrometer S to insure a high magnetic field line integral ( $\int \bar{B} \times d\bar{l}$) in the area of the spatial detector array of the spectrometer S to insure accurate measurement of high energy events.

The second coil 8 is mounted on the support tube T at an opposite end from the first coil 6 and provides an opposing magnetic field to that of the coil 6 in order to cancel dipole interaction with the magnetic field of the earth while in orbit, to reduce magnetic influence on spacecraft guidance and attitude controls from the coils 6 and 8 and reduce magnetic effects on other experiments. In order to further reduce these magnetic effects, the apparatus A is preferably located at a remote position in the spacecraft from both the spacecraft center of mass and the other orbital experiments.

Considering the apparatus A more in detail, the cryostat C includes an inner cryostatic pressure vessel 10 which contains a suitable amount of cryogen therein under a high vacuum. As will be set forth below, the cryogen is preferably liquid helium, although other diamagnetic cryogenic liquids may be used if desired. The inner cryostat vessel 10 is generally cylindrical along a central portion 10*a* with relatively flat, ellipsoidal end portions 10*b* and 10*c*. The relatively flat end portion 10*b* decreases the spacing between the coil 6 and spectrometer S, increasing resolution in the spectrometer S. The cryostat vessel 10 is also insulated along an outer surface with at least one layer of low-emittance foil, and has mounted therewith a plurality of fiberglass-epoxy band supports 12 mounted at suitably spaced attachment points along the sides and ends thereof. The supports 12 are mechanically and thermally connected to an inner vapor-cooled shield 14 to intercept conduction heat which would otherwise flow to the pressure vessel 10.

The inner shield 14 is a comparatively thin metal shield, formed from a suitable lightweight metal, such as aluminum. The shield 14 is further formed into a multilayer insulated shield by being wrapped with a suitable number, such as forty, layers of suitable insulating material, such as ¼ mil, aluminized synthetic resin such as Mylar, with a 4 mil thick Dacron knit spacer, applied at a layer density of 66 layers per inch, for example. An annular space 16 is formed between the pressure vessel 12 and the inner vapor-cooled shield 14, for reasons to be set forth below.

An outer vapor-cooled shield 18 is mounted with the inner vapor-cooled shield 14 by spacer supports 20, preferably of like structure and construction to the spacer supports 12. The outer vapor-cooled shield 18 is a thin metal shield of similar metal as the inner shield 14, and is also formed into a multi-layer insulated shield. For increased insulation, the outer shield 18 is wrapped with a suitable number, such as 120, layers of aluminized synthetic resin, with a net spacer preferably of like construction to the wrappings for the inner vapor-cooled shield 14 set forth above. An annular space 22 is provided between the outer vapor-cooled shield 18 and the inner vapor-cooled shield 14, for reasons to be set forth below.

An outer vacuum shell 26 encloses under substantially vacuum conditions the outer vapor-cooled shield 18 and inner shield 14. The outer vacuum shell 26 is mounted by suitable spacer supports 28 to the outer shield 18 in order to enclose the cryostat pressure vessel 10, and inner and outer vapor-cooled shields 14 and 18 under the substantially vacuum conditions.. Thus, the shell 26, shields 18 and 14, and vessel 10 form the cryostat vacuum vessel V to maintain therein a suitable cryogen to keep the magnetic coils M at a suitably low temperature and superconducting for long periods to provide extended duration cosmic ray spectrometry measurements.

A spacecraft mount support girth ring 30 and a spacecraft mount ring 32 of conventional construction are mounted externally of the vacuum shell 26, permitting the apparatus A to be mounted at a suitable location in the spacecraft or orbiting laboratory.

For extended duration experiments, it is important to maintain the magnetic coils M in a superconducting state for long periods. Accordingly, as has been set forth, a suitable cryogenic liquid 34, preferably subcritical helium due to its relatively light weight, is introduced into the interior of the cryostat pressure vessel 10 through a fill line 35 passing through an inlet 37 and suitable openings formed in the shell 26, outer vapor-cooled shield 18, inner vapor-cooled shield 14 and cryostat pressure vessel 10 to the interior of the cryostat pressure vessel 10. The fill line 35, inlet 37 and openings through shell 26, shields 18 and 14 and cryostat pressure vessel 10 are of conventional cryogenic, high vacuum sealing construction. Thus, substantial vacuum conditions are retained in the interior of the cryostat vessel 10 using these conventional high vacuum cryostatic techniques known to those of ordinary skill in the art.

With the liquid cryogen 34, once introduced into the interior of the cryostat pressure vessel 10, and once the spacecraft in which the apparatus A is used has been moved into low gravity conditions, the gas and liquid phases of the cryogen become intermingled. In these conditions, unless proper control is exercised, the liquid phase of the cryogen is vented along with the gaseous phase, severely curtailing the cryogenic effect of the cryogen 34. Further, consideration must be given to maintaining the cryogen 34 sufficiently in contact with the coils M to maintain them in superconduction.

Operation of the superconduction magnets M in a weightless environment during orbital experiments poses a unique operational difficulty not encountered in laboratory experiments. Helium is diamagnetic and is therefore repelled by magnetic fields.

The magnetic force on a unit mass of a substance with magnetic susceptibility, $\chi_m$, is $$\vec{F} = \chi_m (\vec{B} \cdot \vec{\nabla}) \vec{B}$$

where $B$ is the magnetic field strength. For helium $\chi_m$ $-0.47 \times 10^{-6}$ dynes/gram × cm/gauss. Typical values for locations adjacent the surface of the satellite coil M are: $B$=70 kG and $\gamma B$=−10kG/cm. The magnetic body force on the helium cryogen 34 in the vicinity of the coils M is:

$$F = 330 \text{ dynes/gram.}$$

This force corresponds to about one-third the acceleration of gravity at the earth's surface.

In normal laboratory situations a very moderate liquid helium level, for example about 1 centimeter, has sufficient head to maintain contact with the magnet. However, in an orbiting satellite the only forces acting to keep the liquid helium in contact with the coils M are surface tension and accelerations of the spacecraft. For such a coil, surface tension and diamagnetism become comparable for distances from the magnet larger than about 100 cm.

A supercritical cryostat could be used to maintain the magnets M in the superconducting mode. However, because of the helium susceptibility, stratification and reduced heat transfer during charging could be serious problems. In addition, the required tank pressure control system for a supercritical cryostat would be overly complicated.

A sponge or wick type enclosure could be built around the coils to insure liquid contact and to provide refrigeration through the latent heat of vaporization of the helium. Liquid helium has a very low surface tension, $\lesssim$ 0.4 dynes/cm, so such an enclosure must be very dense and would thus add appreciable weight to an orbital system where weight should be minimized.

As has been set forth, the superconducting magnets M and spectrometer S are preferably located at one end of the spacecraft to minimize the magnetic shielding required on the spacecraft control moment gyroscopes and to allow other experiments with highly field-sensitive equipment to be at the opposite end. As an additional desirable feature, it has been found with the present invention that in this orientation the cryostat magnets M are sufficiently far from the spacecraft center of mass so that the the spacecraft rotation settles the cryogen 34 in the vicinity of the coils M.

Once the magnetic coils M are charged, using conventional techniques, the diamagnetism of helium can be used advantageously to extend the cryostat lifetime. With the present invention, it has been found that use can be made of the diamagnetic, or magnetically repelled, property of the cryogenic liquid helium. Accordingly, with the present invention, a vent conduit or tube 36 having a T-shaped vent oultet 38 is mounted in the interior of the cryostat 10 to vent therefrom the gaseous phase of the cryogen helium. By mounting the outlet 38 of vent 36 substantially adjacent one of the superconducting magnets M, where the product of the magnetic field and field gradient of the superconducting magnets are at a maximum, the liquid phase of the cryogenic helium is repelled away from the vent outlet 38, while the less dense gas phase is less repelled, phase separating the liquid and gas phases of the cyrogen and substantially reducing venting of the liquid phase of the helium. In this manner, the liquid cryogen helium 34 may be retained for extended time periods in the interior of the apparatus A, extending the service life of the superconducting magnets M for long duration experiments.

Figure 2:
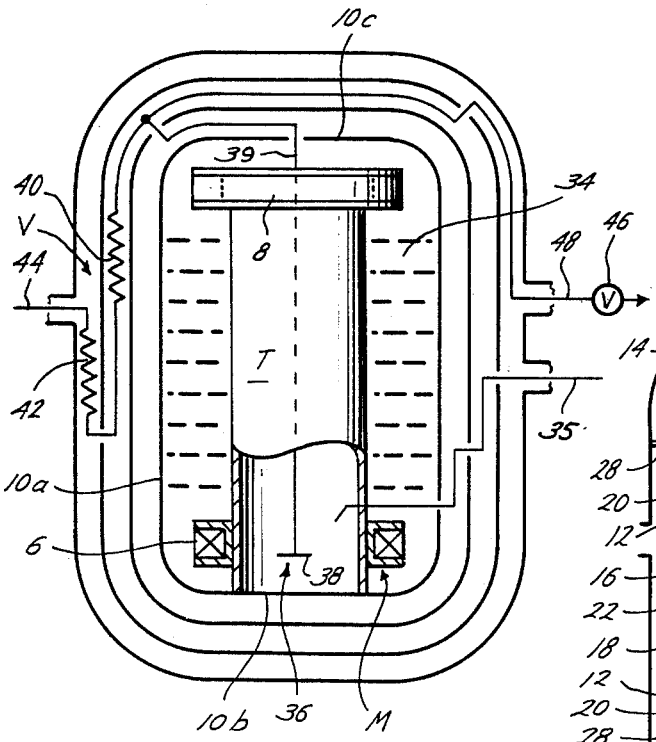
FIGS. 2 and 3 are cross-sectional views of the vessel of FIG. 1.
Figure 3:
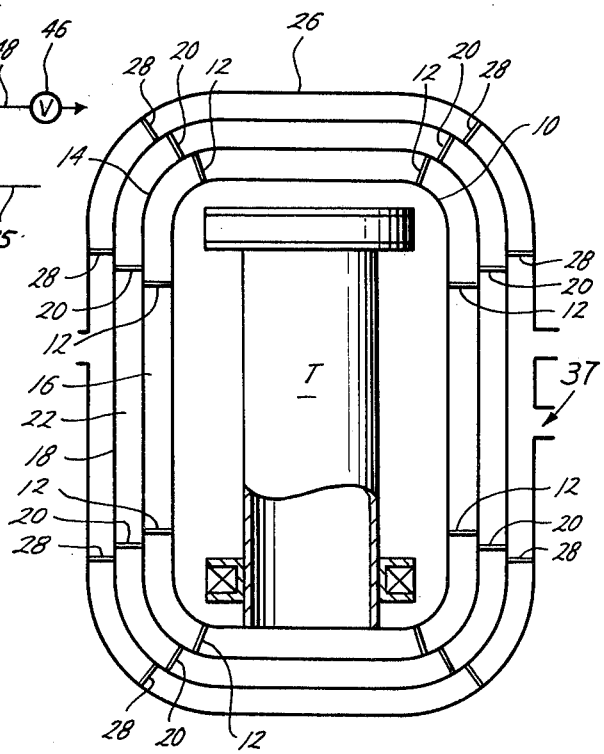

The vent oultet 38 receives the gas phase of the cryogen to be vented, as has been set forth, and permits the gas phase to flow therethrough to gas outlet tube or conduit 39. The gas conduit 39 is of extended length and extends from the interior of the cryostat 10 through a suitable vacuum-sealed opening therein. The extended length conduit 39 is wrapped in serpentine fashion over the inner vapor-cooled shield 14 and the outer vapor-cooled shield 18, as is schematically indicated at 40 and 42 (FIG. 2). The inner vapor-cooled shield 14 thus acts as a boiler, or external thermodynamic phase separator, in a liquid expulsion mode. Also, wrapping the conduit 39 in this serpentine fashion permits advantage to be taken of the refrigerant effect provided by the gaseous helium as it is warmed from cryostatic temperatures of, for example, 4° K to exit temperature, which occurs as the gas phase passes from an outlet conduit 44 to a conventional tank ullage pressure control system for venting.

The vent conduit 39 further may serve as an additional fill line through a control valve 46, mounted with an inlet conduit 48, which is opened during filling operations. In this manner, the fill conduits 36 and the conduit 48 may both be connected to a suitable source of liquid helium to fill the interior of the cryostat pressure vessel 10 with a suitable amount of cryogenic liquid helium. The valve 46 is thereupon closed, providing only one exit, through the conduit 39 and serpentine coils 40 and 42 through the outlet conduit 44 to the tank ullage pressure control system for venting.

In the operation of the present invention, the superconducting magnets are charged in the conventional manner, while liquid helium is introduced into the interior of the cryostat pressure vessel 10 in the manner set forth above.

As has been set forth, in low gravity orbital conditions, the gas and liquid phases of the cryogen in the cryostat pressure vessel 10 tend to intermingle, even with rotational movement of the spacecraft. However, since the vent ine 36 in the cryostat pressure vessel 10 is located in the vicinity of the superconducting magnets M, the liquid phase of the cryogen 34 is repelled from the vent inlets, phase separating the gas and liquid phases of the cryogen, retaining the liquid phase of the cryogen in the interior of the apparatus A, thereby permitting extended duration experiments to be performed.

The foregoing disclosure and description of the invention are illustrative and explanatory thereof, and various changes in the size, shape and materials as well as in the details of the illustrated construction may be made without departing from the spirit of the invention.

We claim:

1. In a superconducting magnetic spectrometer adpated for operation in a low gravity or zero gravity space environment for measuring cosmic rays and like effects, an apparatus for separating the gas and liquid phases of a diamagnetic cryogen under low gravity conditions to reduce venting of the liquid phase of the cryogen, said apparatus comprising:

a. cryostat means for containing the cryogen, b. vent means for venting the gaseous phase of the cryogen from said cryostat means; and c. magnet means mounted in said cryostat means adjacent said vent means for repelling the liquid phase of the diamagnetic cryogen from said vent means to reduce venting of the liquid phase of the cryogen, said magnet means comprising a first superconducting toroidal coil disposed adjacent the spectrometer for providing a deflecting magnetic field in the spectrometer and a second superconducting coil disposed remote from said spectrometer in substantially coaxial relation with said first coil and providing an opposing magnetic field to that of said first coil.

2. An apparatus as described in claim 1 wherein said cryostat means comprises an inner cryostatic pressure vessel and heat conductive shield means enclosing said pressure vessel in spaced apart relationship therewith and, said vent means comprises a venting conduit having an inlet disposed within said pressure vessel and substantially centrally disposed with respect to said first coil whereby it is adapted to receive the gaseous phase of the cryogen, said conduit passing through said heat conductive shield means with part of its length in heat-exchanging relation with said shield means whereby said shield means are subjected to vapor cooling by the flow of vaporized cryogen through the venting conduit to the outlet thereof.

* * * * *